US005669306A

United States Patent [19]

Puschnerat

[11] Patent Number: 5,669,306

[45] Date of Patent: Sep. 23, 1997

[54] RUBBER BLANKET UNIT FASTENING DEVICE

[75] Inventor: Helmut Puschnerat, Wachenheim, Germany

[73] Assignee: Koenig & Bauer-Albert Aktiengesellschaft, Wurzburg, Germany

[21] Appl. No.: 663,814

[22] Filed: Jun. 14, 1996

[30] Foreign Application Priority Data

Jun. 14, 1995 [DE] Germany ..... 195 21 645.8

[51] Int. Cl.[6] ..... B41F 1/28

[52] U.S. Cl. ..... 101/415.1

[58] Field of Search ..... 101/415.1, 409

[56] References Cited

U.S. PATENT DOCUMENTS

| | | | |
|---|---|---|---|
| 2,525,003 | 10/1950 | Smith | 156/154 |
| 2,714,852 | 8/1955 | Stempel | 101/415.1 |
| 5,062,363 | 11/1991 | Reichel | 101/415.1 |
| 5,178,068 | 1/1993 | Junghans et al. | 101/415.1 |
| 5,284,093 | 2/1994 | Guaraldi et al. | 101/415.1 |
| 5,483,891 | 1/1996 | Reichel | 101/415.1 |

FOREIGN PATENT DOCUMENTS

| | | | |
|---|---|---|---|
| 0 060 939 A1 | 10/1982 | European Pat. Off. | 101/415.1 |
| 1 960 635 | 2/1973 | Germany . | |
| 37 07 066 A1 | 10/1988 | Germany | 101/415.1 |
| 35 40 581 | 1/1989 | Germany . | |
| 35 38 308 | 2/1994 | Germany . | |
| 526837 | 12/1938 | United Kingdom | 101/415.1 |
| 2167011 | 5/1986 | United Kingdom | 101/415.1 |

*Primary Examiner*—Stephen R. Funk
*Assistant Examiner*—Leslie Grohusky
*Attorney, Agent, or Firm*—Jones, Tullar & Cooper, P.C.

[57] ABSTRACT

A device for fastening a rubber blanket unit to a blanket cylinder utilizes a rubber blanket secured to the surface of a support plate which is provided with beveled ends. These ends are insertable into a narrow slit in the cylinder and are held in the slit by pressure elements. A plurality of resilient ejectors are supported in this cylinder slit and have free ends which support a filler strip. The filler strip closes the gap between the blanket ends when the rubber blanket is attached to the blanket cylinder.

10 Claims, 2 Drawing Sheets

RUBBER BLANKET UNIT FASTENING DEVICE

FIELD OF THE INVENTION

The present invention is directed generally to a rubber blanket unit fastening device. More particularly, the present invention is directed to a device for securing a rubber blanket unit on a blanket cylinder. Most specifically, the present invention is directed to a device for securing a rubber blanket unit to a blanket cylinder which is provided with a narrow, axially extending blanket plate end receiving slit. The blanket support plate ends are clamped in place in the slit by a plurality of pressure elements. A number of resilient blanket support plate end ejectors are used to move the plate ends in the cylinder slit. A filler piece or strip is secured to axially spaced free ends of these ejectors. This filler piece fills the circumferential gap between the leading and trailing ends of the resilient blanket carried by the blanket support plate and prevents dirt and other contaminants from entering into the narrow cylinder slit.

DESCRIPTION OF THE PRIOR ART

In the field of rotary printing, it is often necessary to secure various plates and other flexible elements to the outer, peripheral surfaces of various ones of the rotatable cylinders in the printing press. These cylinder covers should be securable and should also be removable in an uncomplicated fashion as possible, while ensuring that their attachment to the surface of the cylinder will be secure and reliable. The securement device should also take up as little of the peripheral surface area of the cylinder as possible and should not compromise the structural integrity of the cylinder. The flexible elements being secured to the surface of the cylinder may be blanket units that have a resilient blanket attached to an underlying blanket support plate. The securement of the support plate ends to the cylinder may create a gap or space that could become filled with dirt or other debris. This is apt to make the removal of the flexible blanket unit much more difficult than it would otherwise be.

In U.S. Pat. No. 2,525,003 there is shown a prior art device which is usable to fasten a rubber blanket unit, consisting of a rubber blanket and a support plate, to a cylinder. The rubber blanket unit is provided with two beveled or chamfered edges. On each of these beveled edges a chamfered or beveled leg of the support plate is located so that it projects past the ends of the rubber blanket. The rubber blanket on the support plate terminates in the area of a bevel bounding the legs. These two beveled edges are inserted into a cylinder slot having a width of approximately 3.3 mm. A wedge is positioned between the opposing faces of the two legs of the blanket unit. This wedge serves to press one leg of the rubber blanket against a lateral face of the slot. The rubber blanket unit is frictionally held in the slot by the use of this wedge type holding device.

The German Patent Publication DE 35 38 308 C2 discloses a device that is usable to mount a rubber blanket on a blanket cylinder of a web-fed rotary printing press. In this prior device, the rubber blanket is secured to a dimensionally stable support plate and the two combine to form the rubber blanket unit. A beveled leg of the support plate extends past the rubber blanket at the trailing end of the rubber blanket unit. The beveled let at the leading end of the support plate is coated with the rubber blanket. These two dissimilar ends of the rubber blanket unit can be inserted into a slot of the blanket cylinder in a manner such that the trailing end of the rubber blanket, which ends in a trailing blanket edge, has this edge approximately in contact with the angled end portion of the leading end of the rubber blanket unit.

In the German patent No. 1 960 635 there is disclosed an arrangement that is usable to secure a flexible printing plate to a plate cylinder. In this device, the holding apparatus is comprised of at least one axially extending slit which is formed in the outer peripheral surface of the plate cylinder. The chamfered ends of the printing plate are inserted into this slit.

In all of these prior art devices, a narrow gap remains between the two ends of the place or blanket unit. When the chamfered or angled ends of the plate or the blanket unit are inserted into the axially extending slit in the cylinder, there is created an axially extending narrow gap or crevice. This opening, even through it is relatively narrow, is a collection area for dirt, paper dust, ink particles and other contaminant materials. The build-up of these materials makes the eventual removal of the plate or blanket unit more difficult since it hampers extraction of the plate or blanket unit ends for the thin cylinder slit. This accumulation of dirt or contaminants may also cause print quality deterioration.

It will thus be seen that a need exists for a device which is usable to secure a plate or a blanket unit to a cylinder and which will overcome this problem. The blanket unit fastening device in accordance with the present invention provides such a device and is a significant improvement over the prior art.

SUMMARY OF THE INVENTION

It is an object of the present invention to provide a device for fastening a rubber blanket unit to a blanket cylinder.

Another object of the present inveniton is to provide a device for fastening a rubber blanket unit to a blanket cylinder of a rotary printing press.

A further object of the present invention is to provide a device for fastening a rubber blanket unit to a blanket cylinder by use of a blanket holding device disposed on the blanket cylinder.

Still another object of the present invention is to provide a device for fastening a rubber blanket unit in a narrow, axially extending slit in a blanket cylinder of a rotary printing press.

Yet a further object of the present invention is to provide a rubber blanket unit fastening device which prevents the entrance of dirt into the narrow gap between the blanket unit ends.

As will be discussed in detail in the description of the preferred embodiment which is presented subsequently, the device for fastening a rubber blanket unit to a blanket cylinder of a rotary printing press in accordance with the present invention utilizes a rubber blanket unit which consists of a rubber blanket that is secured to an underlying support plate which is provided with angled or beveled legs. The support plate of the beveled legs of the rubber blanket unit are not coated with the rubber blanket which has edges that are circumferentially spaced slightly from each other when the blanket unit is secured in place on the cylinder. The cylinder itself is provided with an axially extending, generally radially inwardly directed slit which is sized so that it will receive the beveled end legs of the support plate of the rubber blanket unit. A plurality of pressure elements are disposed axially along the slit. Each of these pressure elements is spring biased into engagement with one of the end legs of the support plate. The spring forces of these pressure elements are such that the two adjacent end legs of the support plate can be securely clamped between the lateral face of the cylinder slit and the pressure cams. A plurality of resilient blanket support plate end ejectors are carried by a rotatable spindle which also carries the pressure elements. Theses resilient ejectors are situated in the narrow cylinder slit and have free outer ends that extend beyond the outer peripheral surface of the cylinder. An axially extending filler strip or filler piece is carried by these ejector free ends. When the spindle is rotated to cause the blanket support plate ends to be drawn radially inwardly into the cylinder slit, the filler strip or filler piece will be positioned between the slightly circumferentially spaced ends of the rubber blanket. This filler piece will thus close the narrow axially extending gap or crevice which would otherwise be left open.

Since the gap between the two rubber blanket ends is substantially closed by the filler strip, there is not space for dirt or other contaminants to collect. This insures that the rubber blanket unit will be easier to remove from the blanket cylinder when it is time to do so. It also insures that the printing quality will not be adversely affected by the possible collection of dirt or other contaminants in the gap which would exist were it not for the provision of the filler piece or strip in accordance with the present invention.

The filler strip reduces wear on the edges of the rubber blanket carried by the blanket support plate. If the filler piece were not used, there would be crated two axially extending edges at the leading and trailing ends of the rubber blanket. These edges, which define the gap that is closed or filled by the filler piece, would be subject to much greater wear in the absence of the filler strip or piece of the subject invention.

Another advantage of the blanket unit fastening device in accordance with the present invention is the provision of an essentially continuous outer surface on the blanket cylinder. The filler strip closes the discontinuity that would otherwise exist and thus prevents any possible cylinder oscillations or so-called cylinder bounce that is apt to occur when a cylinder with a discontinuous surface rolls off another cylinder. Even though the gap or slit that has existed in prior art devices was quite narrow, the present invention effectively eliminates this gap. The elimination of this gap is accomplished by the present invention without the need to resort to rubber blanket sheaths instead of rubber blanket units having ends. These sheaths typically present installation and retention problems since they must be essentially slid over the surface of the blanket cylinder.

The device for securing a blanket unit to a cylinder in accordance with the present invention overcomes the limitations of the prior art devices. It is a substantial advance in the art.

BRIEF DESCRIPTION OF THE DRAWINGS

While the novel features of the rubber blanket unit fastening device in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
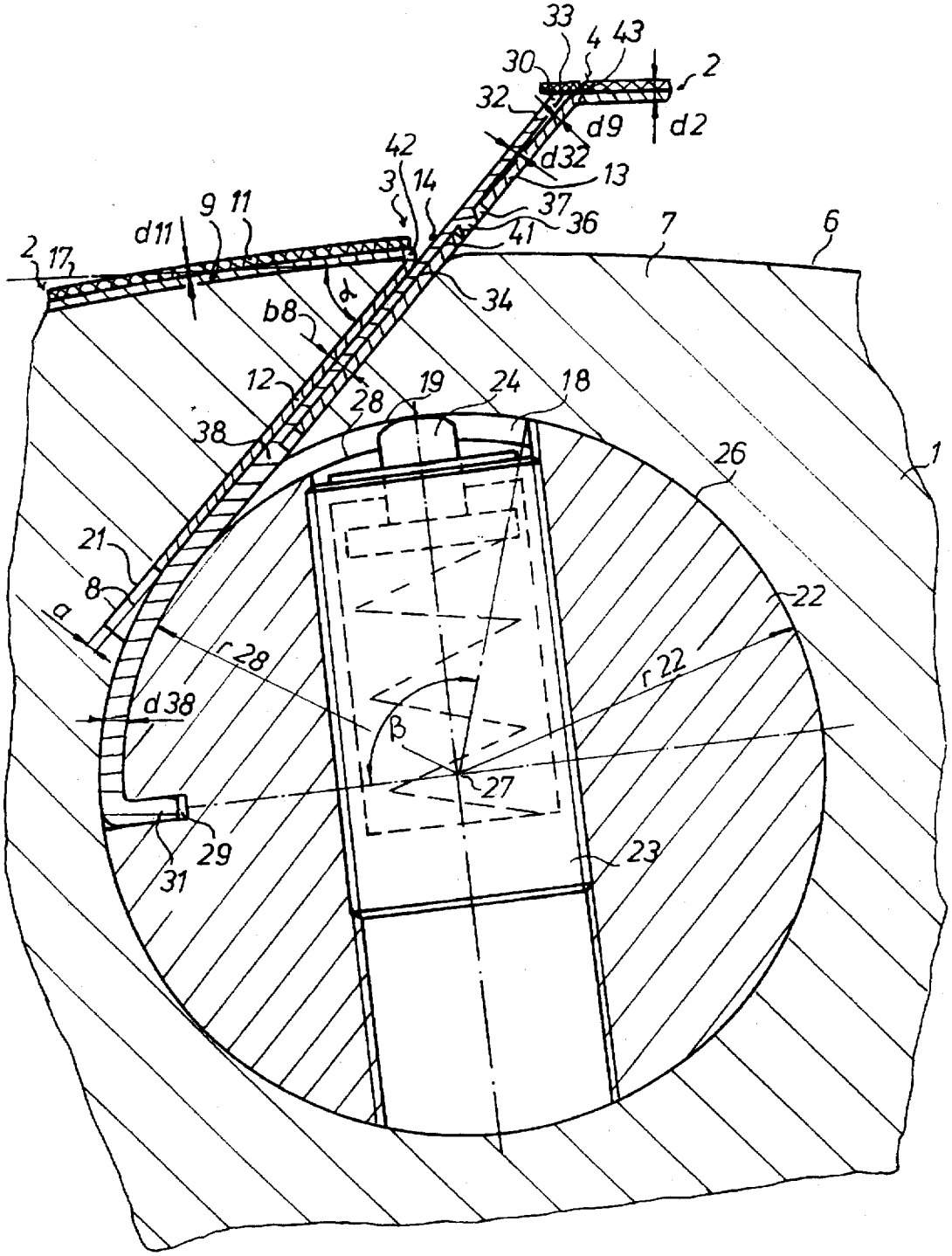
FIG. 1 is a schematic cross-sectional view of a portion of a blanket cylinder and showing the rubber blanket unit fastening device in accordance with the present invention in the insertion position.
Figure 2:
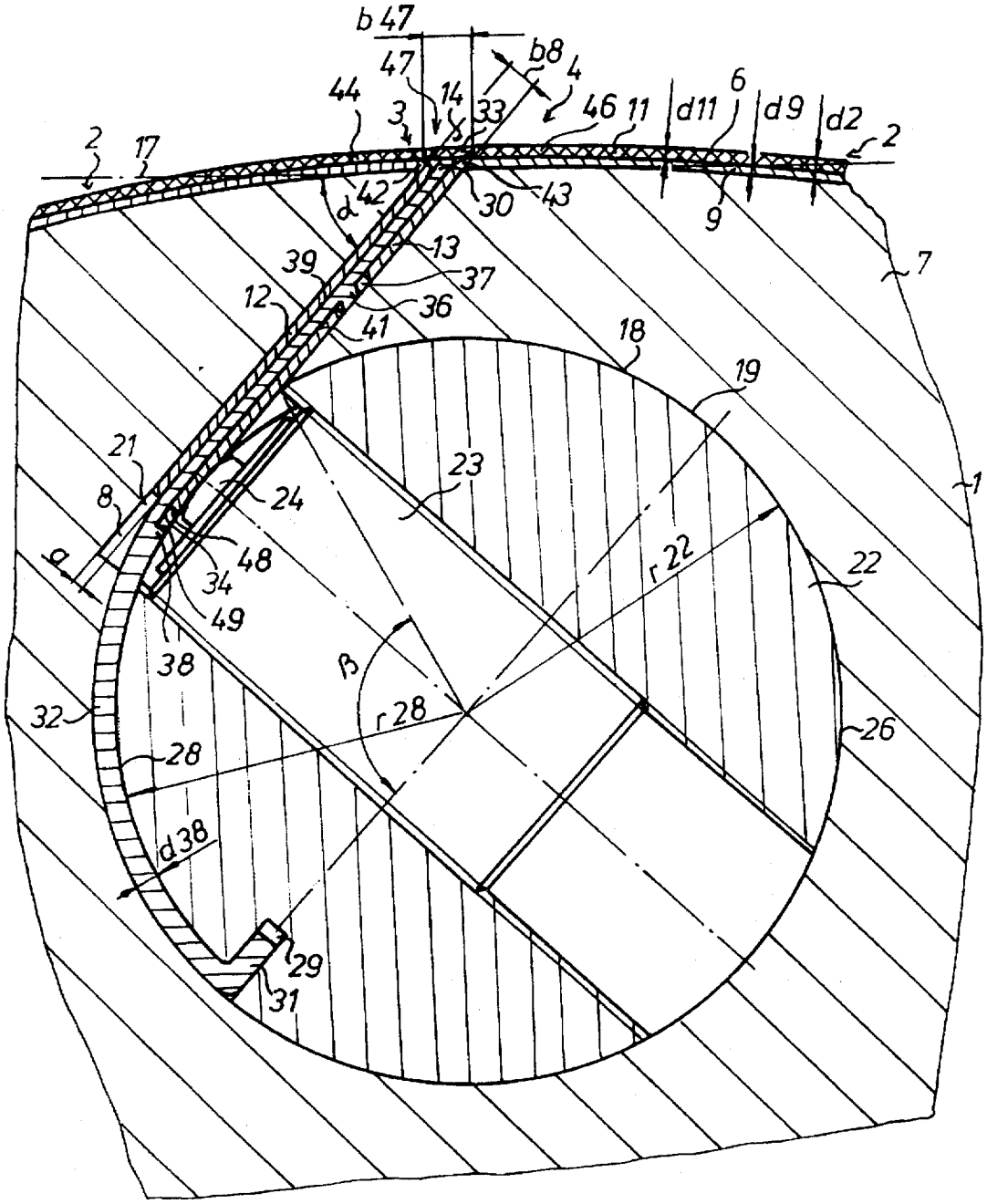
FIG. 2 is a view generally similar to FIG. 1 and showing the device in the clamping position.

Referring initially to FIG. 1, and also referring to FIG. 2, there may be seen at 1 a portion of a blanket cylinder which is a part of a rotary printing press and in which the rubber blanket unit in accordance with the present invention is situated. It will be understood that cylinder 1 is a blanket cylinder that forms part of a rotary printing press. The overall structure of the cylinder 1 and of the rotary printing press form no part of the subject invention and are thus not described in detail.

Cylinder 1 is structured to receive flexible rubber blanket units 2 on its cylinder surface 6 and is provided with at least one axially extending, generally radially inwardly directed thin slit 8 that is parallel to the axis of rotation of cylinder 1 and which extends generally radially inwardly in cylinder 1 from a slit outer end 14 at the surface 6 of the cylinder 1 into the cylinder interior 7. The flexible rubber blanket unit 2, that is situated on the surface 6 of the cylinder 1, is provided with leading and trailing beveled or angled ends 3 and 4, respectively. As may be seen in FIGS. 1 and 2, these leading and trailing beveled plate ends 3 and 4 are receivable in narrow slit 8 when flexible blanket unit 2 is positioned on the surface 6 of the cylinder 1.

The rubber blanket unit 2 has a thickness d2 of, for example, d2=2.2 mm. Rubber blanket unit 2 consists essentially of a generally dimensionally stable, flexible support plate 5, which is, for example, a metal plate having a plate thickness d9 of, for example, d9=0.3 mm. A rubber blanket 11, with a blanket thickness d11 of, for example, d11=1.9 mm is secured to the support plate 9 by being glued or vulcanized thereto.

In the present invention, the leading end 3 of the support plate 9 of the rubber blanket unit 2 has a leading beveled end leg 12 while the trailing end 4 of the support plate 9 has a trailing beveled end leg 13. In the plate 9 depicted in the drawings, the leading end leg 12 is longer than the trailing end leg 13 of the plate 9. The rubber blanket 11 is fastened on the support plate 9 in such a way that the leading and trailing end legs 12 and 13, respectively, of the support plate 9 are unencumbered by the rubber blanket 11 at the beveled edges 3 and 4 of the rubber blanket unit 2. Only the two end legs 12 and 13 of the support plate 9 extend into the slit 8. It would also be possible to cover the end legs 12 and 13 of the support plate 9 with the rubber blanket 11.

As may be seen in FIGS. 1 and 2, the narrow slit 8 is preferably generally rectangular in cross-section. The cylinder slit 8 has a width b8 at its outer end 14 which is slightly greater than twice the thickness d9 of the plate 9. The slit 8 is inclined at an angle of inclination $\alpha$ of generally 45° with respect to a line 17 which is tangent to the surface 6 of the cylinder 1 at the location of the slit 8.

An axially extending bore 18 is formed in the cylinder 1 and extends parallel with the cylinder slit 8. An inner end of the slit 8 is in contact with the bore 18 and forms a chord with respect to the bore 18. In the subject invention, there is a virtual continuation of a surface area 19 of the bore 18 at a distance "a" in respect to a lateral face 21 of the slit 8 facing away from the bore 18. This distance "a" is slightly greater than the thickness d9 of the support plate 9. For example, a=0.4 mm.

A pivot lever 22 which, in the subject invention, is configured as a spindle 22 having a radium r22 of, for example, r22=15 mm, is seated in the bore 18. The pivot lever or spindle 22 is centered in the cylinder bore 18 and is rotatable with respect to the cylinder 1 in the bore 18. A plurality of outwardly acting pressure elements, generally at 23, are axially spaced along the length of the spindle 22. These pressure elements 23 are secured in the spindle 22 in such a way that pressure cams 24, which are part of the pressure elements 23, can resiliently act or extend radially outwardly beyond a circumferential surface 26 of the spindle 22. Each of these pressure cams 24 may be provided with a ball or generally rounded end cap at its radially outer end. Other end shapes, such as cylinder segments, are also possible. Each pressure cam 24 forms a contact zone, which may be, for example, linear with the surface of the plate end leg which it contacts, as seen in FIG. 2.

As may be seen in both of FIGS. 1 and 2, the circumferential surface 26 of the spindle 22 is discontinuous about its circumferential length. In the area of radially outwardly acting pressure elements 23, the surface area 26 of the spindle 22 has a surface area portion 28 of a reduced radius r28 in which r28=14.5 mm. This reduced radius surface area portion 28 has an arcuate length β of generally 70° with respect to a longitudinal axis 27 of the spindle 22. This reduced diameter portion 28 terminates in an axially extending spindle surface channel or slot 29 that is cut into spindle 22 and which extends radially inwardly into the spindle 22 from its surface 28.

A plurality of resilient ejectors 32 are situated in the axially extending slit 8 in the cylinder 1. A first or inner end 31 of each resilient ejector 32 is positioned in the spindle channel 29. These resilient ejectors 32 are made of a flexible, elastic but pressure resistent material and in the preferred embodiment are leaf springs made of spring steel. Each of these ejectors has a free outer end 30 which extends outwardly of the cylinder slit 8 and beyond the peripheral surface 6 of the cylinder 1.

As may be seen in both FIGS. 1 and 2, a filler strip or piece 33 is secured to the outer ends 30 of the axially spaced resilient ejectors 32. This filler strip or piece 33 can be form fit to the outer ends 30 of the ejectors 32 or can be bonded to them using a suitable adhesive or similar fastener. Instead of providing the ejectors 32 as a plurality of individual elements, they could be formed as a single unit which would be generally comb-like with the ejectors 32 forming the teeth of the comb and with the filler piece or strip 33 forming the spine or back of the comb.

The filler strip or piece 33 is preferably an elastic material which is similar in composition to the material used as the resilient blanket 11 on the blanket support plate 9 of the blanket unit 2. The filler strip or piece 33 can be vulcanized directly onto the outer ends 30 of the resilient ejectors 32 and preferably extends axially over the entire length of the slit 8 or at least over the entire width of the rubber blanket unit 2 secured to the cylinder 1. This filler strip 33 could also be made of the same material as is used to form the resilient ejectors 32 and thus can be formed directly on or as a part of the ejectors 32, as was discussed above. It would also be possible to make the ejectors 32 resilient by producing the ends 30 of the ejectors from a resilient material.

Again referring to FIGS. 1 and 2, each resilient ejector 32, intermediate its outer end 30 and its inner end 31, is provided on its side surface 34 facing the trailing blanket support plate end let 13 with at least one barb or hook 36. Each such barb 36 is receivable in a corresponding aperture 37 in the blanket support plate end leg 13, as may be seen most clearly in FIG. 1. Each of the resilient ejectors 32 may have one or more barbs 36 so that there is provided an axially extending group of barbs 36 which are engageable with a corresponding axial array or apertures 37 in the blanket support plate trailing end leg 13.

As may also be seen in FIGS. 1 and 2, each resilient ejector 32 has a reduced thickness portion starting at a central shoulder 38 and extending out to its free outer end 30. This shoulder 38 is formed on the same side 34 of each ejector 32 as is the barb or hook 36. The reduced thickness portion of each resilient ejector 32 has a thickness d32 of, for example, d32=0.5 mm. The increased thickness portion of the resilient ejector 32; i.e. that portion of the ejector inboard of the shoulders 38 has a thickness d38 of, for example, d38=0.9 mm. When the resilient ejectors 32 are secured to the rotable spindle 22 by insertion of these inner ends 31 into the spindle channel or slot 29, they conform to the shape of the reduced diameter portion 28 of the spindle 22 and extend outwardly through the cylinder slit 8 with their free ends 30 extending out beyond the peripheral surface 6 of the cylinder 1.

The operation of this device for clamping a plate or a rubber blanket unit on a cylinder in accordance with the present invention will now be discussed in detail. With the cylinder 1 in a blanket end insertion position, as depicted in FIG. 1, the spindle 22 has been rotated sot hat the reduced diameter portion 28 is generally adjacent the inner end of the cylinder slit 8. This situates the resilient ejectors 32 with their free ends 30 and the filler strip 33 positioned beyond the surface 6 of the cylinder 1 and with the pressure elements 23 out of contact with the cylinder slit 8. In this plate end insertion position, the two end beveled legs 12 and 13 of the support plate 9 of the beveled rubber blanket ends 3 and 4 of the rubber blanket unit 2 can be inserted into the slip 8. The two beveled ends 3 and 4 of the rubber blanket unit 2 are matched to the angle of inclination α of the slot 8. As was discussed above, the width b8 of the cylinder slit 8 is only slightly greater than twice the thickness d9 of the support plate 9 of the blanket unit 2, plus the thickness d32 of the reduced thickness portion of the ejector 32. Thus b8 may be approximately 1.3 mm in the preferred embodiment. In the insertion position depicted in FIG. 1, the two chamfered or beveled end legs 12 and 13 of the leading and trailing ends 3 and 4 of the support plate 9 of the blanket unit 2 are guided into the cylinder slit 8 with the reduced thickness portion of the resilient ejectors 32 disposed between the end legs 12 and 13 and with the filler strip or piece 33 situated generally adjacent the outer surface of the rubber blanket 11. The reduced thickness portion of the resilient ejector 32 is thus sandwiched between the two inner side surfaces 39 and 41 of the end legs 12 and 13 of the support 9. During an actual insertion operation, the end leg 12 of the leading end 3 of the support plate 11 is inserted into the cylinder slit 8 as far as possible. Insertion of this end leg 12 of the leading end 3 will be terminated by contact of the support plate 9 with the cylinder periphery 6. After the end leg 12 of the leading end 3 of the blanket unit 2 has been inserted into the cylinder slit 8, the end leg 13 of the trailing end 4 of the blanket unit 2 will be inserted into the slit 8, on the opposite side of the resilient ejectors 32, until each ejector's barb 36 is received in its cooperating plate trailing end leg aperture 37.

When the rubber blanket unit 2 is placed on the blanket cylinder 1, the leading and trailing end legs 12 and 13 of the support plate 9, which are not provided with a rubber blanket 11, will be positioned with their respective side surfaces 34 and 36 directly engaging the surfaces of the resilient ejectors 32. The rubber blanket 11, which is secured to the surface of the blanket support plate 9, but which does not extend to the end legs 12 and 13 of the support plate 9 terminates, at the leading and trailing blanket ends 3 and 4 in rubber blanket edges 44 and 46. These edges 44 and 46 of the rubber blanket 11, which generally overlie the bent or chamfered portions 42 and 43 of the end legs 12 and 13 of the support plate 9, form a narrow gap 47 which is seen most clearly in FIG. 2 and which has a gap width b47 of, for example, b47=1 mm. It is this gap 47 that is filled by the filler strip or piece 33 when the ejectors 32 are fully retracted down into the cylinder slit 8 by rotation of the spindle 22.

As soon as the beveled end legs 12 and 13 of the support plate 9 of the rubber blanket unit 2 have been inserted into the cylinder slit 8, the spindle 22 will be rotated in a counterclockwise direction into the clamping position which is depicted at FIG. 2. This counterclockwise rotation of the spindle 22 will locate the pressure elements 23 so that they are generally perpendicular with the blanket end legs 12 and 13 and so tat their pressure cams 24 will bear against the end legs 12 and 13 of the beveled support plate ends 3 and 4. These pressure cams 24 may be pressed against he plate end legs 12 and 13 by the force of suitable springs which are carried within the pressure elements, as is depicted in a somewhat schematic fashion in the drawings. At the same time, the rotation of the spindle 22 will pull the resilient ejectors 32 with the supported filler strip or piece 33 radially inwardly into the cylinder slit 8. The barbs 36 which are in their corresponding apertures 37 in the trailing end leg 13 of the blanket support plate 9, will also act to pull the trailing end leg 13 down into the cylinder slit 8. Rotation of the spindle 22 continues until the surface of the support plate 9 is pulled down against the peripheral surface 6 of the cylinder 1 and until the filler piece or strip 33 fills the gap 47 between the oppositely located ends 44 and 46 of the rubber blanket 11. In this position, the end legs 12 and 13 of the support plate 9 of the blanket unit 2, and the resilient ejectors 32 are clamped in the cylinder slit 8 by the pressure cams 24 of the pressure elements 23, all as may be seen most clearly in FIG. 2. The ends 3 and 4 of the rubber blanket unit 2 are thus securely fastened to the cylinder 1. It will be appreciated that the spring forces and the spring path of the springs in the pressure elements 23 will be selected to provide adequate clamping forces. The counterclockwise rotation of the clamping spindle 22, together with the action of the pressure cams 24 acting generally in the direction of the interior 7 of the blanket cylinder 1 effects a tightening of the ends 3 and 4 of the blanket unit 2 by means of an inwardly acting tensile force. The spindle 22 can be stopped in the clamping position and can then be stopped and retained in that position by any suitable mechanism.

When it is desired to release the blanket unit beveled ends 3 and 4 of the rubber blanket unit 2 from the narrow slit 8, the spindle 22 will be rotated in a clockwise direction into a plate end ejection position. As the spindle 22 is rotated in this clockwise direction, the pressure elements 23 will move out of contact with the legs 12 and 13 of the blanket unit ends 3 and 4 to thus release the ends. This rotation of the spindle 22 brings the pressure elements 23 into the portion of the cylinder bore 18 in which the pressure cams 24 engage the surface 19 of the cylinder bore 18. As the spindle 22 is rotated in the clockwise direction, the free ends 30 of the resilient ejector 32 will also move the filler strip or piece 33 radially out beyond the surface 6 of the cylinder 1. At the same time, a support surface 49 that is formed by the shoulder 38 of each of the resilient ejectors 32 will press against an end face 48 of the end leg 13 of the trailing blanket unit end 4. This causes the end leg 13 to be pushed out of the cylinder slit 8. The ends 3 and 4 of the rubber blanket unit are now completely removed from the slit 8 on the cylinder 1.

While the rubber blanket unit fastening device in accordance with the present invention has been discussed hereinabove as utilizing pressure springs in the pressure elements 23 to urge the pressure cams 24 radially outwardly, it would also be possible to utilize pre-stressed leaf springs in place of the pressure elements 23 and pressure cams 24. Such pre-stressed leaf springs would be arranged in the circumferential direction of the clamping lever or spindle 22 and would extend radially outwardly beyond the surface area 26 of the spindle 22.

While a preferred embodiment of a rubber blanket unit fastening device in accordance with the present invention has been set forth fully and completely hereinabove, it will be apparent to one of skill in the art that a number of changes in, for example, the overall size of the cylinder, the type of printing being done by the printing press, the drive for the press and the like could by made without departing from the true spirit and scope of the present invention which is accordingly to be limited only by the following claims.

What is claimed is:

1. In a rotary printing press, the combination comprising:

a blanket cylinder;

a narrow, axially extending, generally radially inwardly directed slit formed on a peripheral surface of said blanket cylinder and extending inwardly into said cylinder from an outer surface of said cylinder;

a flexible rubber blanket unit having leading and trailing beveled ends, said rubber blanket unit further having a rubber blanket fastened on an underlying support plate, said rubber blanket having a leading edge and a trailing edge, said support plate having a leading end leg and a trailing end leg, said support plate end legs projecting past said blanket leading and trailing edges, said support plate end legs having inner and outer lateral faces, said leading and trailing support plate end legs being insertable in said slit;

a rotatable pivot spindle positioned in said cylinder and extending generally parallel to said slit for rotation between a support plate end leg insertion position and a support plate end leg clamping position;

a plurality of ejectors supported for movement in said slit between said support plate end leg insertion and clamping positions, each said ejector having a free outer end and an inner end secured to said rotatable pivot spindle, said ejectors being shiftable in said slit in response to rotation of said pivot spindle, each said ejector being positionable between said leading and trailing support plate end legs when said end legs are inserted in said slit; and a filler strip attached to said outer ends of said plurality of ejectors and extending generally axially, said filler strip and said ejector free ends extending beyond said blanket cylinder peripheral surface in said insertion position, said filler strip being disposed between said rubber blanket leading and trailing edges in said clamping position to close a gap defined by said rubber blanket leading and trailing edges.

2. The device of claim 1 wherein each said ejector has side surfaces, said outer lateral faces of said plate end legs engaging said ejector side surfaces and further including holding means pressing said beveled ends and each said ejector against a side surface of said slit.

3. The device of claim 2 wherein said holding means includes said rotatable spindle and further includes a plurality of radially acting pressure cams carried by said spindle and spaced axially along said spindle, said pressure cams being engageable with one of said beveled ends of said support plate.

4. The device of claim 1 wherein each said ejector is a flexible material.

5. The device of claim 1 wherein said filler strip is a material the same as said rubber blanket.

6. The device of claim 1 wherein said filler strip extends axially over an entire width of said rubber blanket unit.

7. The device of claim 1 wherein said filler strip and said ejectors are spring steel.

8. The device of claim 1 further including a barb on a side surface of each said ejector, and a plurality of apertures on one of said leading and trailing support plate end legs, each said barb being receivable in a corresponding one of said apertures and operating to pull said apertured end leg of said plate into said slit during inward movement of each said ejector.

9. The device of claim 1 further including a shoulder formed on a side surface of each said ejector intermediate said inner and outer ends of each said ejector, said shoulder being engageable with an end face of one of said plate ends to move said plate end out of said slit during outward movement of said ejectors.

10. The device of claim 1 wherein said slit has a slit width generally twice a thickness of said support plate plus a thickness of each of said ejectors.

* * * * *